US010578344B2

(12) United States Patent
Wallet-Laily

(10) Patent No.: US 10,578,344 B2
(45) Date of Patent: Mar. 3, 2020

(54) REVERSIBLE LIQUID SUCTION GAS HEAT EXCHANGER

(71) Applicant: Carrier Corporation, Jupiter, FL (US)

(72) Inventor: Jeremy Wallet-Laily, Saint-Cyr-au-Mont-d'Or (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 81 days.

(21) Appl. No.: 15/752,654

(22) PCT Filed: Aug. 19, 2015

(86) PCT No.: PCT/IB2015/001555

§ 371 (c)(1),
(2) Date: Feb. 14, 2018

(87) PCT Pub. No.: WO2017/029534

PCT Pub. Date: Feb. 23, 2017

(65) Prior Publication Data

US 2018/0238593 A1 Aug. 23, 2018

(51) Int. Cl.
*F25B 13/00* (2006.01)
*F25B 40/00* (2006.01)
(Continued)

(52) U.S. Cl.
CPC ..... *F25B 13/00* (2013.01); *F25B 40/00* (2013.01); *F25B 41/04* (2013.01); *F25B 49/02* (2013.01);
(Continued)

(58) Field of Classification Search
CPC ..... F25B 13/00; F25B 40/00; F25B 41/04; F25B 49/02; F25B 2313/021;
(Continued)

(56) References Cited

U.S. PATENT DOCUMENTS 3,397,552 A 8/1968 Harnish
4,030,315 A 6/1977 Harnish
(Continued)

FOREIGN PATENT DOCUMENTS

BE 899256 A 7/1984
EP 1555494 A2 7/2005
(Continued)

OTHER PUBLICATIONS

DK-Kälteanlagen GmbH, "Functional principle, DK-Suction Gas Heat Exchanger", DK-Kälteanlagen GmbH, 2015, 2 pages.
(Continued)

*Primary Examiner* — Marc E Norman
(74) *Attorney, Agent, or Firm* — Cantor Colburn LLP

(57) ABSTRACT

A heat pump system includes a compressor, indoor heat exchanger, outdoor heat exchanger, and expansion valve. A main flow control device fluidly couples a discharge line to the outdoor heat exchanger when the heat pump system is in a cooling mode, and fluidly couples the discharge line to the indoor heat exchanger when the heat pump system is in a heating mode. An intermediate heat exchanger is configured to receive working fluid from the outdoor heat exchanger in a cooling mode and from the indoor heat exchanger in a heating mode. The intermediate heat exchanger is configured to superheat or sub-cool a working fluid therein. A secondary flow control device is configured to control a directional flow of working fluid between the indoor heat exchanger, the outdoor heat exchanger and the intermediate heat exchanger. A controller is operably coupled to the main and secondary flow control devices.

8 Claims, 2 Drawing Sheets

(51) Int. Cl.
*F25B 41/04* (2006.01)
*F25B 49/02* (2006.01)

(52) U.S. Cl.
CPC . *F25B 2313/021* (2013.01); *F25B 2313/0272* (2013.01); *F25B 2313/0292* (2013.01); *F25B 2313/02741* (2013.01); *F25B 2600/2513* (2013.01); *F25B 2600/2515* (2013.01)

(58) Field of Classification Search
CPC .... F25B 2313/0272; F25B 2313/02741; F25B 2313/292; F25B 2600/2513; F25B 2600/2515
See application file for complete search history.

(56) References Cited

U.S. PATENT DOCUMENTS

| | | | | |
|---|---|---|---|---|
| 4,106,307 | A * | 8/1978 | Matsuda | F24F 3/001 62/324.4 |
| 4,236,381 | A | 12/1980 | Imral et al. | |
| 5,479,789 | A | 1/1996 | Borten et al. | |
| 6,185,957 | B1 | 2/2001 | Voss | |
| 6,227,003 | B1 | 5/2001 | Smolinsky | |
| 6,351,950 | B1 | 3/2002 | Duncan | |
| 6,378,323 | B1 | 4/2002 | Chavagnat | |
| 6,457,325 | B1 | 10/2002 | Modine | |
| 6,755,046 | B2 | 6/2004 | Nishida et al. | |
| 6,901,763 | B2 | 6/2005 | Memory et al. | |
| 7,114,349 | B2 | 10/2006 | Lifson et al. | |
| 7,185,506 | B2 | 3/2007 | Aflekt et al. | |
| 7,647,790 | B2 | 1/2010 | Ignatiev et al. | |
| 2004/0159117 | A1 | 8/2004 | Wang | |
| 2005/0103487 | A1 | 5/2005 | Aflekt et al. | |
| 2005/0262873 | A1 | 12/2005 | Hirota | |
| 2006/0196225 | A1 | 9/2006 | Han | |
| 2010/0147006 | A1 | 6/2010 | Taras et al. | |
| 2010/0243200 | A1 | 9/2010 | Baker et al. | |
| 2013/0145780 | A1 | 6/2013 | Parsonnet et al. | |
| 2015/0075196 | A1 | 3/2015 | Yanachi | |

FOREIGN PATENT DOCUMENTS

| | | | |
|---|---|---|---|
| FR | 2937589 | A1 | 4/2010 |
| WO | 2009062739 | A1 | 5/2009 |

OTHER PUBLICATIONS

International Search Report and Written Opinion for application PCT/IB2015/001555, dated Apr. 22, 2016, 10 pages.

* cited by examiner

Heating mode

REVERSIBLE LIQUID SUCTION GAS HEAT EXCHANGER

BACKGROUND

The present disclosure relates to reversible heat pump refrigeration systems, and more particularly, to a system for improving frost tolerance in heating mode and the seasonal efficiency of a heat pump operating in both a cooling mode and heating mode Air conditioners, refrigerators, and heat pumps produce a controlled heat transfer by evaporating a liquid refrigerant in a heat exchanger under appropriate pressure conditions to produce the desired evaporator temperatures. Liquid refrigerant removes its latent heat of vaporization from the medium being cooled, being converted into a vapor at the same pressure and temperature. This vapor is then conveyed into a compressor where its temperature and pressure are increased. The vapor then is conducted to a separate heat exchanger serving as a condenser where the gaseous refrigerant absorbs its heat of condensation from a heat transfer fluid in heat exchange relation therewith, changing state from a gas to a liquid. The liquid is supplied to an evaporator after flowing through an expansion device which acts to reduce the pressure of the liquid refrigerant so that the liquid refrigerant evaporates within the evaporator to absorb its heat of vaporization and complete the cycle.

When operating in a heating mode, an outdoor heat exchanger coil of a heat pump circuit is configured as the evaporator. The evaporator is typically located in ambient air, which sometimes drops to temperatures below the freezing point of water. Thus, as the cold ambient air circulates over the outdoor coil, water vapor in the air condenses and freezes on the surfaces of the outdoor coil. As frost accumulates on the outdoor coil, a layer of ice builds up between the portion of the outdoor coil carrying refrigerant and the air flowing over it. This layer of ice acts as an insulating layer inhibiting the heat transfer in the coil between the refrigerant and the air. In addition, the ice may block narrow air flow passageways between fins used to enhance heat transfer. This additional effect further reduces the heat transfer since lesser amounts of air are circulated in heat exchange relation with the refrigerant carrying conduits.

It is necessary to remove the accumulated frost to efficiently operate a heat pump in relatively low outdoor ambient air conditions. Many conventional methods are known such as supplying electric resistance heat, reversing the heat pump such that the evaporator becomes a condenser, or other refrigerant circuiting techniques to direct hot gaseous refrigerant directly to the frosted heat exchanger. Many of these defrost techniques use energy that is therefore not used to transfer heat energy to the space to be heated.

SUMMARY

According to an embodiment of the present disclosure, a heat pump system includes a compressor, indoor heat exchanger, outdoor heat exchanger, and expansion valve. A main flow control device fluidly couples a discharge line to the outdoor heat exchanger when the heat pump system is in a cooling mode, and fluidly couples the discharge line to the indoor heat exchanger when the heat pump system is in a heating mode. An intermediate heat exchanger is configured to receive working fluid from the outdoor heat exchanger in a cooling mode and from the indoor heat exchanger in a heating mode. The intermediate heat exchanger is configured to superheat or sub-cool a working fluid therein. A secondary flow control device is configured to control a directional flow of working fluid between the indoor heat exchanger, the outdoor heat exchanger and the intermediate heat exchanger. A controller is operably coupled to the main and secondary flow control devices.

In addition to one or more of the features described above, or as an alternative, in further embodiments the heat pump system includes a main circuit and a secondary circuit fluidly coupled to the main circuit. The intermediate heat exchanger is positioned within the secondary circuit.

In addition to one or more of the features described above, or as an alternative, in further embodiments the secondary flow control device includes at least one valve positioned at an interface between the main circuit and the secondary circuit. The at least one valve is configured to restrict a direction of flow based on whether the heat pump system is configured in a cooling mode and a heating mode.

In addition to one or more of the features described above, or as an alternative, in further embodiments the at least one valve is operably coupled to the controller.

In addition to one or more of the features described above, or as an alternative, in further embodiments the expansion device is positioned within the secondary circuit. The expansion device is arranged downstream from the intermediate heat exchanger.

In addition to one or more of the features described above, or as an alternative, in further embodiments working fluid from both the outdoor heat exchanger and the indoor heat exchanger is provided to the intermediate heat exchanger with a sufficiently high pressure.

In addition to one or more of the features described above, or as an alternative, in further embodiments a receiver is configured to increase a charge of the heat pump system.

In addition to one or more of the features described above, or as an alternative, in further embodiments the main flow control device is a four way valve.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
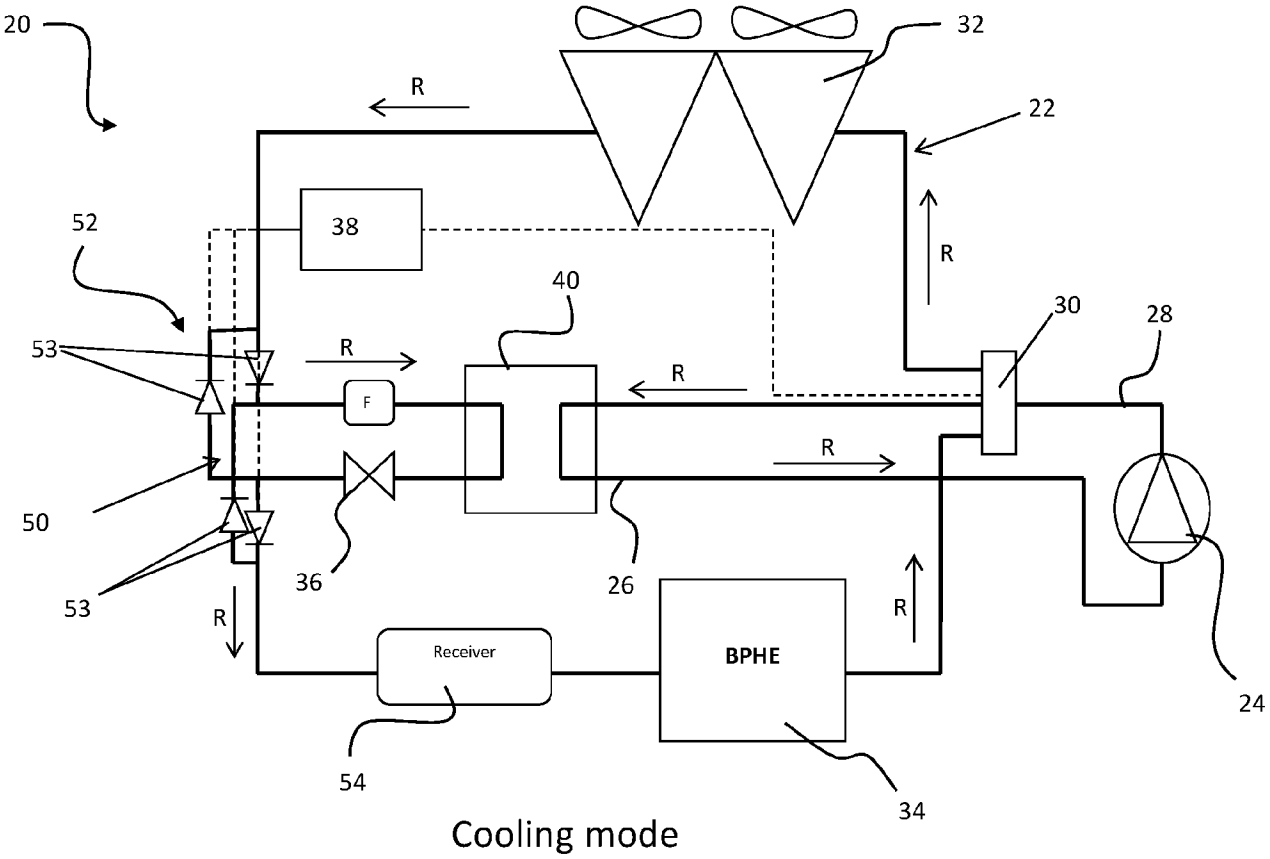
FIG. 1 is a schematic diagram of a heat pump system configured in a cooling mode according to an embodiment of the present disclosure.
Figure 2:
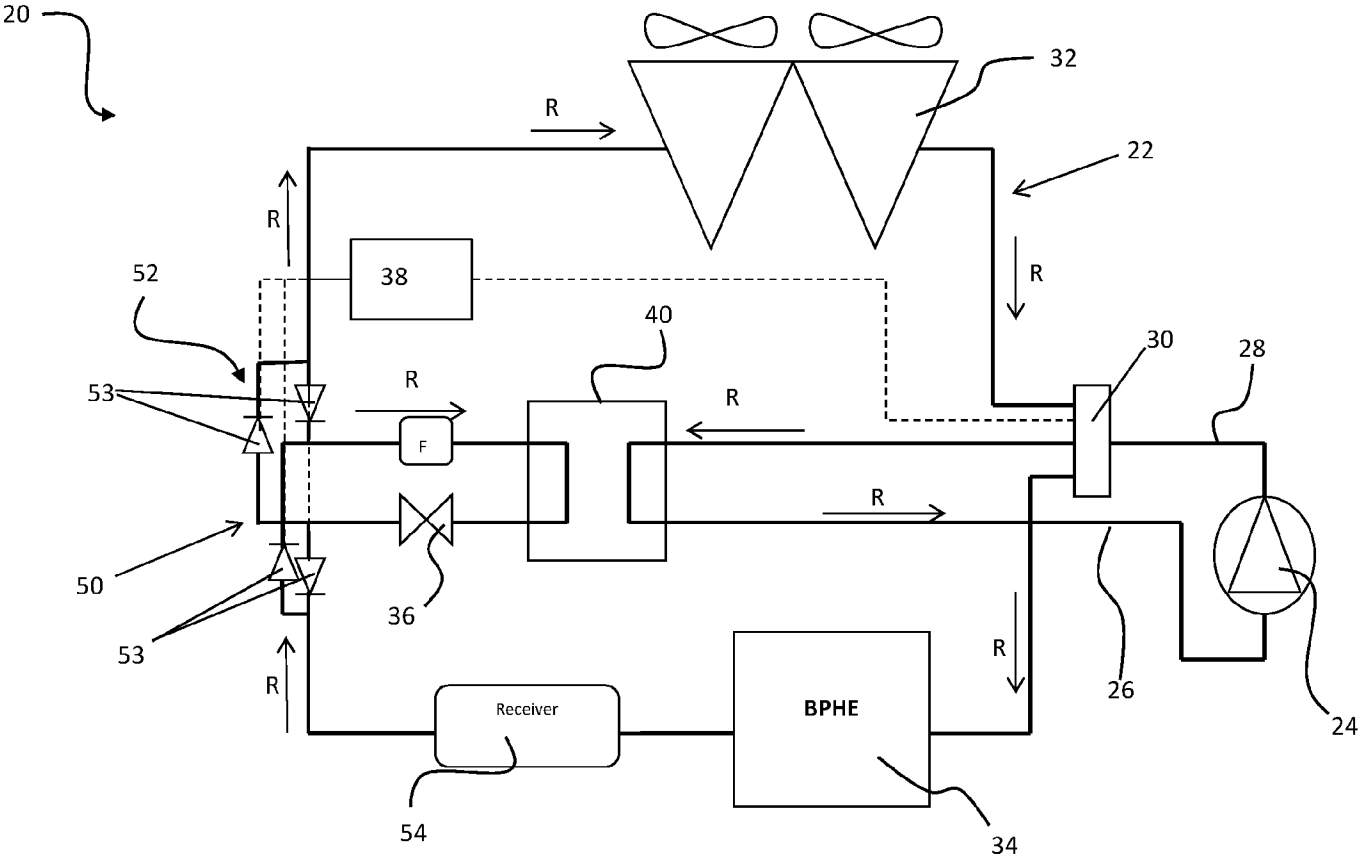
FIG. 2 is a schematic diagram of the heat pump system of FIG. 1 configured in a heating mode according to an embodiment of the present disclosure.

Referring now to the FIGS., an example of a heat pump system 20 according to an embodiment of the disclosure is illustrated. The heat pump system 20 has a main refrigerant circuit 22 including a compressor 24. Although the heat pump system 20 is described herein as using a refrigerant as the working fluid, other fluids, such as another coolant or water for example, are within the scope of the disclosure. The compressor 24 is configured to receive refrigerant to be compressed from a suction line 26 and to discharge compressed refrigerant to a discharge line 28. A main flow control device 30, such as a four way reversing valve for example, routes the refrigerant to either an outdoor heat exchanger 32, as shown in FIG. 1, or to an indoor heat exchanger 34, as shown in FIG. 2, depending on the mode of operation of the heat pump system 20. The outdoor and indoor heat exchangers 32, 34 may be configured as any type of heat exchanger, such as a brazed plate heat exchanger, a round tube plate fin heat exchanger, and a microchannel heat exchanger for example. A controller, illustrated schematically at 38, is operably coupled to the compressor 24 and the four way reversing valve 30 and is configured to transform operation of the heat pump system 20 between a first cooling mode and a second heating mode.

With reference now to FIG. 1, when the system 20 is operated in the cooling mode, the refrigerant passes from the discharge line 28 through the four-way reversing valve 30 to the outdoor heat exchanger 32. Fluidly coupled to the outdoor heat exchanger 32 is an expansion device 36, and downstream from the expansion device 36 is the indoor heat exchanger 34. The refrigerant is returned to the compressor 24 through the four-way reversing valve 30 and through the suction line 26. In the conventional cooling mode of operation, the outdoor heat exchanger 32 is configured as a condenser and the indoor heat exchanger 34 is configured as an evaporator. As a result, air flowing over the indoor heat exchanger 34 is cooled and usually dehumidified before being supplied to an environment to be conditioned.

When the system 20 is operated in the heating mode, as shown in FIG. 2, the refrigerant passes from the discharge line 28, through the four way valve 30, to the indoor heat exchanger 34. From the indoor heat exchanger 34, the refrigerant is configured to flow through the expansion device 36 and the outdoor heat exchanger 32 sequentially. From the outdoor heat exchanger 32, the refrigerant is returned to the four-way reversing valve 30 where it is provided to the suction line 26 and back to the compressor 24. In the heating mode, the indoor heat exchanger 34 is configured as a condenser and the outdoor heat exchanger 32 is configured as an evaporator. As a result, the air flowing over the indoor heat exchanger 34 is heated before entering the environment to be conditioned.

As shown in the FIGS., the heat pump system 20 additionally includes an intermediate heat exchanger 40, configured to the further increase the heat transfer of the refrigerant. In the illustrated, non-limiting embodiment, the intermediate heat exchanger 40 is a refrigerant to refrigerant heat exchanger positioned such that gaseous refrigerant within the suction line 26 is provided to the intermediate heat exchanger 40 before being supplied to the compressor 26. The intermediate heat exchanger 40 is additionally positioned upstream from the thermal expansion device 36 and directly downstream from the outdoor heat exchanger 32 when the heat pump system 20 is operated in the cooling mode, and downstream from the indoor heat exchanger 34 when the heat pump system 20 is operated in the heating mode. The refrigerant provided to the intermediate heat exchanger 40 from either the outdoor heat exchanger 32 or the indoor heat exchanger 34 is generally a liquid.

To ensure that refrigerant from both the outdoor heat exchanger 32 and the indoor heat exchanger 34 is provided directly to the intermediate heat exchanger 40, depending on the mode of operation, a secondary refrigerant circuit 50 is fluidly coupled to the main refrigerant circuit 22 between the outdoor and indoor heat exchangers 32, 34. A secondary flow control device 52, for example including a plurality of check valves 53 as shown in the FIGS., may be arranged at the interface between the secondary refrigerant circuit 50 and the main refrigerant circuit 22. However, in other embodiments, the secondary flow control device 52 may include other components, such as a four way reversing valve for example, configured to control the directional flow of the refrigerant. The secondary flow control device 52 is configured to ensure that refrigerant flow between the main refrigerant circuit 22 and the secondary refrigerant circuit 50 occurs in only the desired direction depending on a current mode of operation of the heat pump system 20. In the illustrated, non-limiting embodiment, both the intermediate heat exchanger 40 and the expansion device 36 are positioned within the secondary refrigerant circuit 50. By positioning both the intermediate heat exchanger 40 and the expansion device 36 within the secondary refrigerant circuit 50, the sequential flow of refrigerant there through is maintained in a simple and effective manner.

In addition, arranging the intermediate heat exchanger 40 within the secondary refrigerant circuit 50 ensures that the liquid refrigerant is supplied thereto with a sufficiently high pressure. In one embodiment, the heat pump system 20 includes a receiver 54 configured to add refrigerant to the fluid flow path to achieve a necessary charge. As shown, the receiver 54 is positioned within the main refrigerant circuit 22, near the indoor heat exchanger 34. However, other embodiments where the receiver 54 is arranged at another location within the main refrigerant circuit 22, or alternatively within the secondary refrigerant circuit 50, are within the scope of the disclosure.

When operated in the cooling mode, a hot liquid refrigerant output from the outdoor heat exchanger 32 is provided to the intermediate heat exchanger 40. Within the intermediate heat exchanger 40, additional heat is configured to transfer from the liquid refrigerant to the relatively cool vaporized refrigerant, provided via the suction line 26. As a result, the refrigerant from the suction line 26 is superheated, and simultaneously, the liquid refrigerant from the outdoor heat exchanger 32 is subcooled. When the heat pump system 20 is operated in a heating mode, as shown in FIG. 2, a partially cooled liquid refrigerant is provided from the indoor heat exchanger 34 to the intermediate heat exchanger 40. As previously described, the heat transfer in the intermediate refrigerant-refrigerant heat exchanger superheats the gaseous refrigerant and sub cools the liquid refrigerant.

By including the intermediate heat exchanger 40, in additional to the heat exchange surface provided by the heat exchanger 32, 34 configured as an evaporator, depending on the operational mode of the heat pump system 20, a further heat transfer surface is provided to superheat the refrigerant or working fluid. This additional intermediate heat exchanger 40 increases the evaporation temperature, and thus positively affects the coefficient of performance (COP) of the heat pump system 20. At the same time, the intermediate heat exchanger 40 provides an additional heat transfer surface for the required sub cooling of the working fluid. The decreased temperature of the condensed working fluid also positively affects the COP of the heat pump system 20. The resultant heat pump system 20 provides improved seasonal efficiency.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

I claim:

1. A reversible heat pump system, comprising:

a compressor configured to receive a working fluid from a suction line and provide compressed working fluid to a discharge line;

an indoor heat exchanger and an outdoor heat exchanger;

a main flow control device configured to fluidly couple the discharge line to the outdoor heat exchanger when the heat pump system is operated in a cooling mode, and to fluidly couple the discharge line to the indoor heat exchanger when the heat pump system is operated in a heating mode;

an expansion valve;

an intermediate heat exchanger configured to receive working fluid from the outdoor heat exchanger when the heat pump system is operated in a cooling mode and to receive working fluid from the indoor heat exchanger when the heat pump system is operated in a heating mode, wherein the working fluid provided to the intermediate heat exchanger in both the cooling mode and the heating mode is a liquid and the intermediate heat exchanger is configured to superheat or sub-cool the working fluid therein, wherein the expansion valve is arranged directly downstream from the intermediate heat exchanger relative to a flow of working fluid in both the cooling mode and the heating mode;

a secondary flow control device configured to control a directional flow of the working fluid between the indoor heat exchanger, the outdoor heat exchanger, and the intermediate heat exchanger; and a controller operably coupled to the main flow control device and the secondary flow control device.

2. The reversible heat pump system according to claim 1, wherein the heat pump system includes a main circuit and a secondary circuit fluidly coupled to the main circuit, the intermediate heat exchanger being positioned within the secondary circuit.

3. The reversible heat pump system according to claim 2, wherein the secondary flow control device includes at least one valve positioned at an interface between the main circuit and the secondary circuit, the at least one valve being configured to restrict a direction of flow based on whether the heat pump system is configured in a cooling mode and a heating mode.

4. The reversible heat pump system according to claim 3, wherein the at least one valve is operably coupled to the controller.

5. The reversible heat pump system according to claim 3, wherein the expansion valve is positioned within the secondary circuit.

6. The reversible heat pump system according to claim 2, wherein working fluid from both the outdoor heat exchanger and the indoor heat exchanger is provided to the intermediate heat exchanger.

7. The reversible heat pump system according to claim 2, further comprising a receiver configured to increase a charge of the heat pump system.

8. The reversible heat pump system according to claim 1, wherein the main flow control device is a four way valve.

* * * * *